US006508566B1

(12) United States Patent
Roorda

(10) Patent No.: US 6,508,566 B1
(45) Date of Patent: Jan. 21, 2003

(54) UNDER CABINET HALOGEN LIGHT FIXTURE WITH INTERNAL WIRE RACEWAY

(75) Inventor: John W. Roorda, Del Mar, CA (US)

(73) Assignee: Westek Associates, Inc., San Diego, CA (US)

( * ) Notice: Subject to any disclaimer, the term of this patent is extended or adjusted under 35 U.S.C. 154(b) by 0 days.

(21) Appl. No.: 09/074,147

(22) Filed: May 7, 1998

(51) Int. Cl.[7] ..... F21V 33/00

(52) U.S. Cl. ..... 362/133; 362/33; 362/221; 362/307

(58) Field of Search ..... 362/240, 221, 362/246, 251, 133, 33, 307

(56) References Cited

U.S. PATENT DOCUMENTS

| | | | | |
|---|---|---|---|---|
| 1,074,537 A | * | 9/1913 | Abeles | 362/240 |
| 3,061,716 A | | 10/1962 | Benander | |
| 3,836,766 A | | 9/1974 | Auerbach | |
| 4,298,919 A | | 11/1981 | Karasawa | |
| 4,358,635 A | | 11/1982 | Druffel | |
| 4,642,742 A | * | 2/1987 | de Vos et al. | 362/269 |
| 5,063,486 A | | 11/1991 | Cummings, III et al. | |
| 5,426,572 A | | 6/1995 | Weinstock et al. | |
| 5,842,775 A | * | 12/1998 | Roorda et al. | 362/133 |

OTHER PUBLICATIONS

"Wiremold Catalog and Wiring Guide" No. 28, Rev. 4, The Wiremold Company, West Hartford, CT. 25 Pages (Selected), Dated 10/91.

* cited by examiner

*Primary Examiner*—Mark A. Robinson
(74) *Attorney, Agent, or Firm*—Brown Martin Haller & McClain LLP

(57) ABSTRACT

An under cabinet halogen light fixture with an internal wire raceway includes a housing having a base and a removable cover, which when mated, define a hollow interior. The light fixture also includes at least one lamp assembly mounted inside the housing. Adjacent each lamp assembly there is a corresponding bezel assembly mounted in a respective aperture formed in the cover. A wall member located in the base defines at least one internal wire raceway in the interior of the housing, which routes electrical wires to each lamp assembly from an external wire raceway, or from a hole in the base of the housing where the electrical wires enter the housing. If needed, the hole in the base of the housing is created by removing a punch out portion from the base. To mate the internal wire raceway with an external wire raceway, a breakaway portion formed in the housing adjacent the internal wire raceway is removed from the housing to create a passageway that is shaped to receive the external wire raceway. A tongue shaped for insertion into the external wire raceway is formed in the housing adjacent the breakaway portion to connect the internal wire raceway with the external wire raceway.

10 Claims, 4 Drawing Sheets

UNDER CABINET HALOGEN LIGHT FIXTURE WITH INTERNAL WIRE RACEWAY

BACKGROUND OF THE INVENTION

1. Field of the Invention

The present invention relates generally to light fixtures, and more particularly, to an under cabinet halogen light fixture configured in the form of a relatively thin narrow bar adapted to be mounted on a downwardly facing surface of a cabinet. More specifically, the present invention relates to a light fixture having a housing and cover specially configured to provide an internal wire raceway for enclosing electrical conductors and connecting with an external wire raceway.

2. Description of the Related Art

In recent years, low wattage accent lighting has become popular in home decorating. In one form of this accent lighting, strings of low voltage incandescent lights have been mounted beneath kitchen cabinets. More recently, low profile light fixtures incorporating small halogen lamps have become popular. These light fixtures typically include a stamped metal backing plate which is secured with screws to the underside of the cabinet, a removable stamped metal cover which encloses one or more halogen lamp assemblies, lenses, a switch, and possibly a transformer. See for example U.S. Pat. No. 5,426,572 granted Jun. 20, 1995 to Steven P. Weinstock et al.

In many jurisdictions, the local government mandates that electrical installations meet certain codes, such as the National Electrical Code (NEC). Such codes frequently require that surface mounted wiring, typically installed long after construction, be enclosed in protective outer conduits or raceways.

The present invention is directed to solving the problem of rapidly and safely connecting an under cabinet light fixture to a source of electrical power while still meeting the applicable electrical codes.

SUMMARY OF THE INVENTION

It is therefore a primary object of the present invention to provide an under cabinet light fixture that has an internal wire raceway that is connectable with an external wire raceway containing electrical wires, such as ROMEX™ wires.

It is another object of the present invention to provide an under cabinet light fixture having an internal wire raceway that is connectable with electrical wires, such as ROMEX wires, through a hole in the light fixture adjacent the internal wire raceway.

The present invention provides a light fixture having a unique internal configuration for routing electrical wires. The light fixture includes a housing having a base and a removable cover. When mated, the base and the cover define a hollow interior. The light fixture also includes at least one lamp assembly mounted inside the housing. Adjacent each lamp assembly there is a corresponding bezel assembly mounted in a respective aperture formed in the cover. At least a portion of each bezel assembly allows light from the lamp assembly to pass through it.

The light fixture also includes a wall member located in the base that defines at least one internal wire raceway in the interior of the housing. The internal wire raceway routes electrical wires to each lamp assembly from an external wire raceway, or from a hole in the base of the housing adjacent the internal wire raceway where the electrical wires enter the housing. If needed, the hole in the base of the housing is created by removing one of several punch out portions from the base. To mate the internal wire raceway with an external wire raceway, a breakaway portion formed in the housing adjacent the internal wire raceway is removed from the housing to create a passageway that is shaped to receive the external wire raceway. A tongue shaped for insertion into the external wire raceway is formed in the housing adjacent the breakaway portion to connect the internal wire raceway with the external wire raceway.

DESCRIPTION OF THE DRAWINGS

The nature, objects, and advantages of the invention will become more apparent to those skilled in the art after considering the following detailed description in connection with the accompanying drawings, in which like reference numerals designate like parts throughout, wherein.

DESCRIPTION OF THE PREFERRED EMBODIMENT

Figure 1:
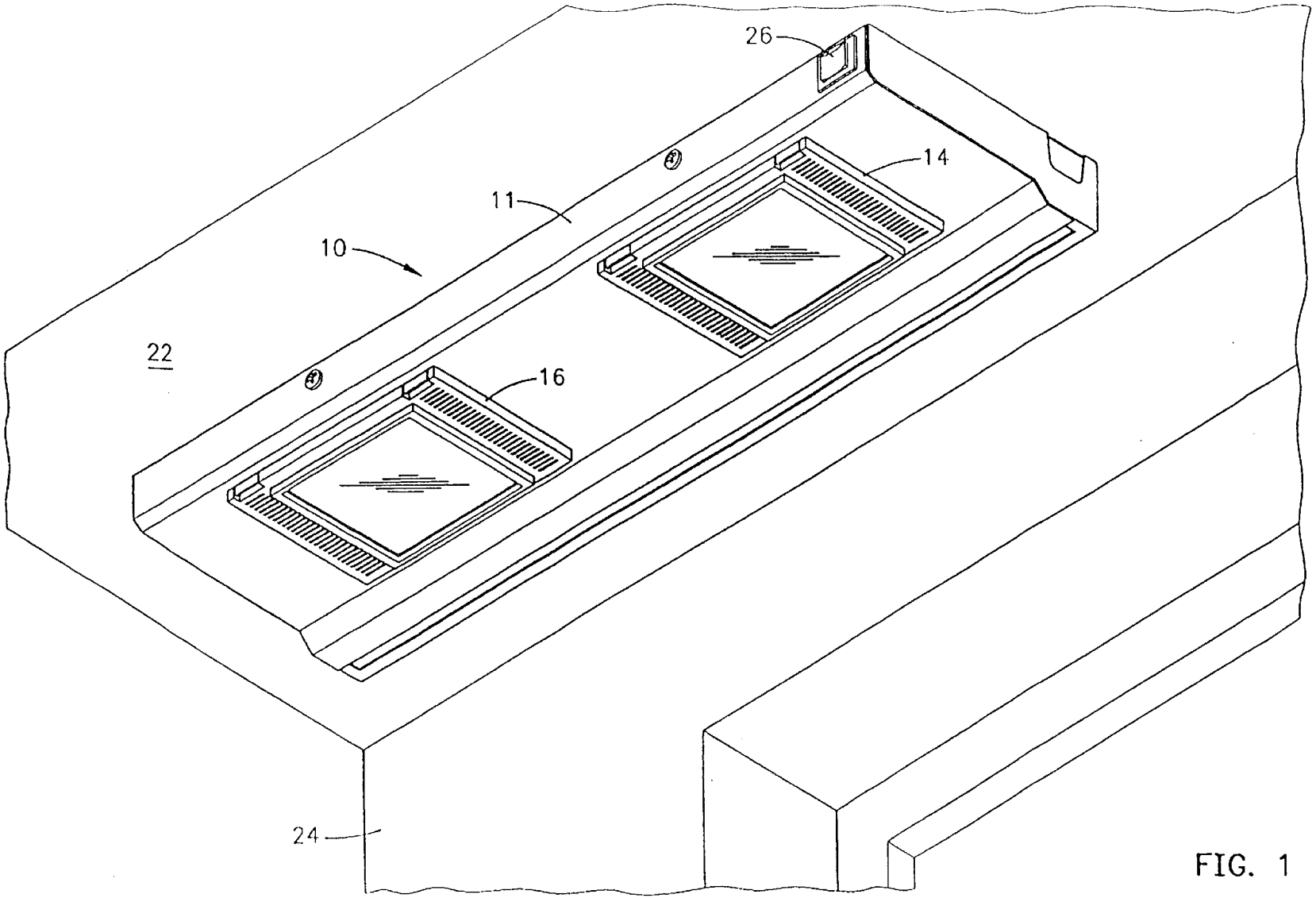
FIG. 1 is a perspective view of a light fixture mounted to the underside of a cabinet next to a window, the light fixture embodying a preferred embodiment of the present invention.
Figure 2:
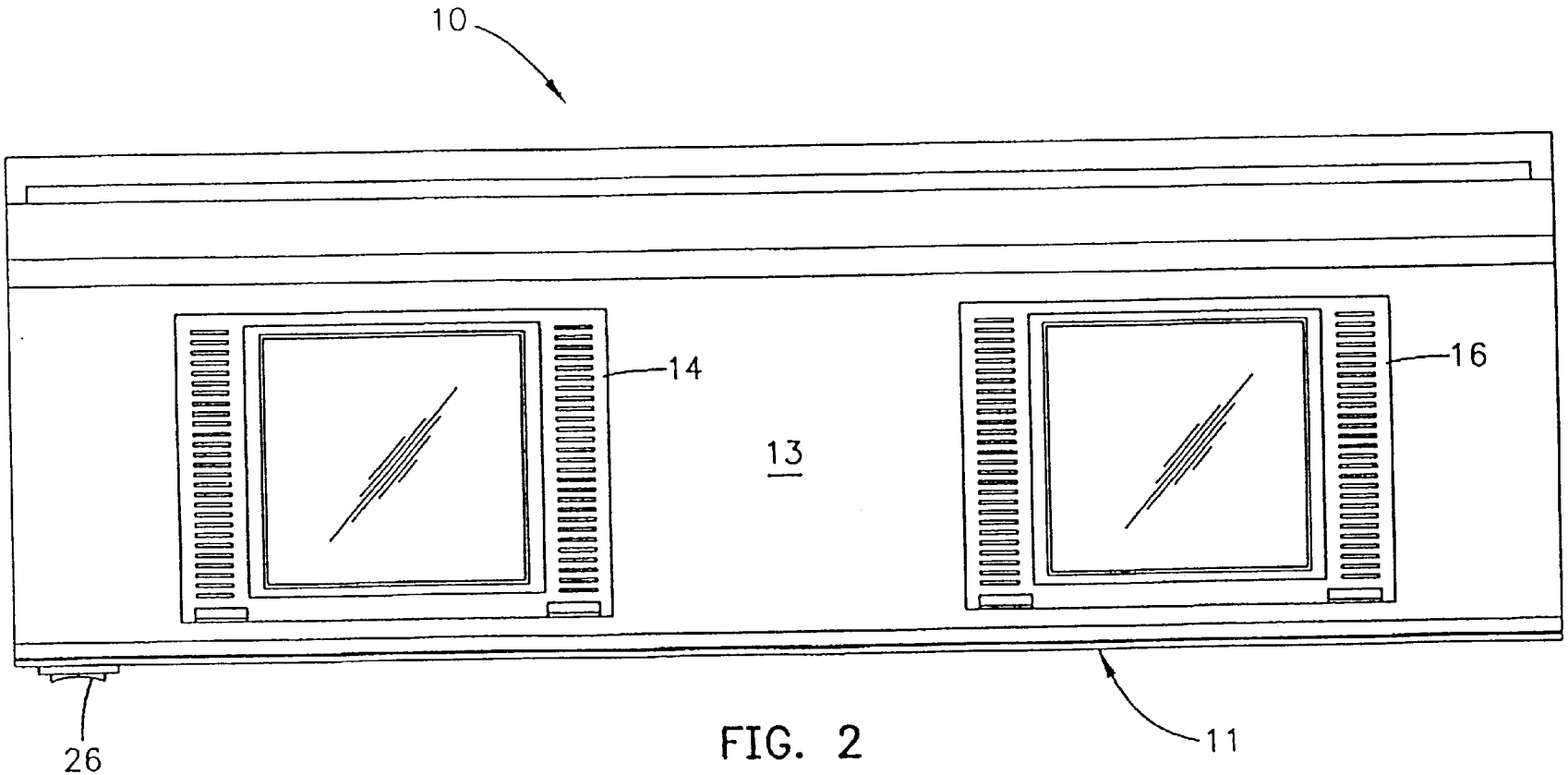
FIG. 2 is an enlarged bottom plan view of the light fixture of FIG. 1.
Figure 3:
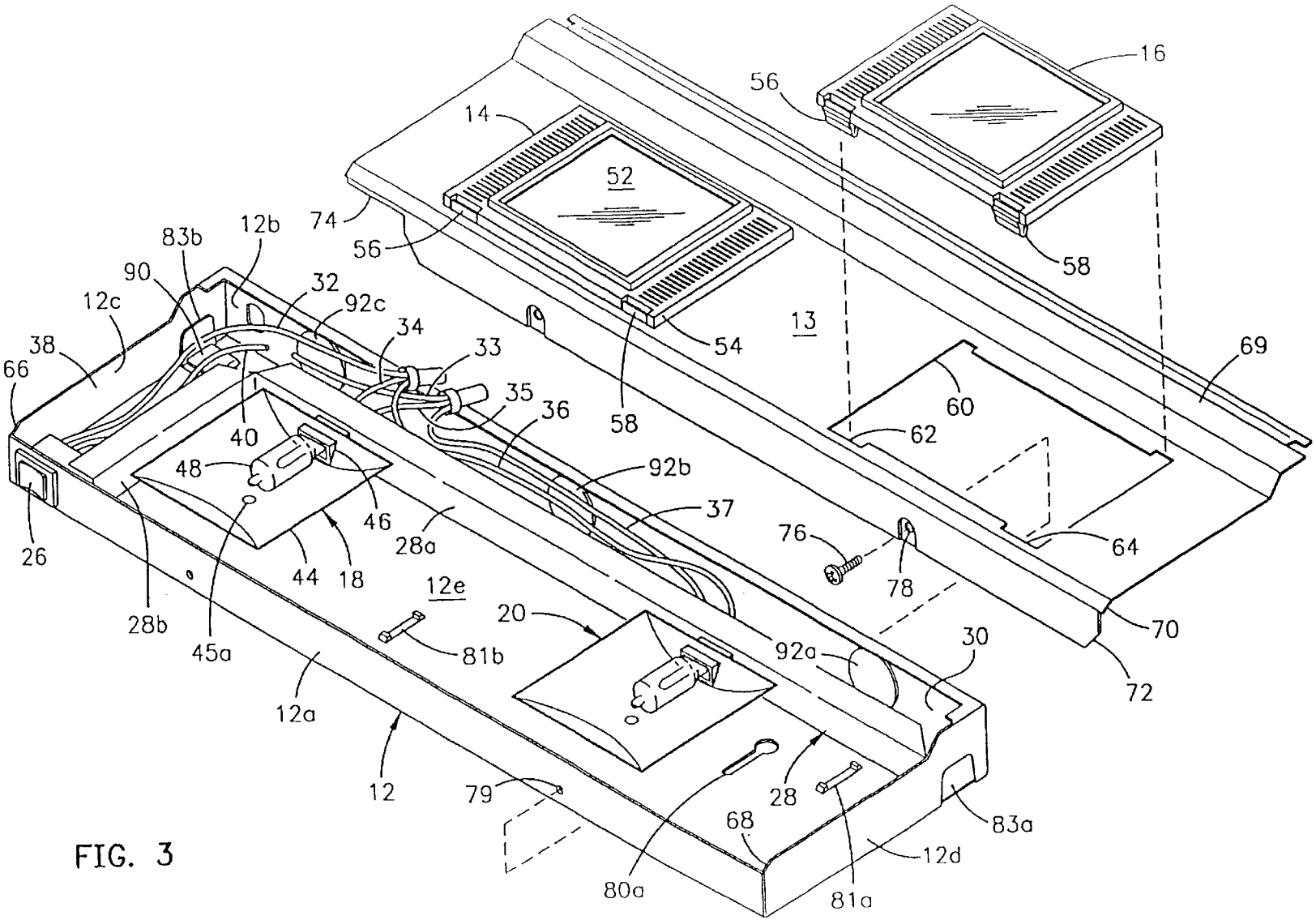
FIG. 3 is an enlarged exploded view of the light fixture of FIG. 1.

In accordance with my invention, a light fixture 10 (FIGS. 1 and 2) comprises a generally rectangular metal housing 11. Referring to FIG. 3, the housing 11 includes a generally box-like rectangular base 12 and a cover 13, that when mated define a hollow interior of the housing 11. The base 12 and the cover 13 are preferably made of sheet metal, such as cold rolled steel, which is stamped and bent to provide the configurations illustrated in FIG. 3. A pair of rectangular bezel assemblies 14 and 16 are mounted in respective apertures 60 in the cover 13. A pair of lamp assemblies 18 and 20 (FIG. 3) are mounted within the housing 11 behind the bezel assemblies 14 and 16, respectively. When the light fixture is installed below the underside 22 of a wooden kitchen cabinet, located for example, adjacent a window frame 24, the lamp assemblies 18 and 20 point downwardly and provide accent illumination on a counter top (not illustrated). The lamp assemblies 18 and 20 may be simultaneously energized and de-energized by manual actuation of a rocker switch 26 mounted on a front wall 12*a* of the base 12.

A wall member 28, which is preferably L-shaped, is mounted inside the base 12. The wall member 28 includes a first leg 28*a* which extends parallel to the front and rear walls 12*a* and 12*b* of the base 12, and a second leg 28*b* which extends parallel to the sidewalls 12*c* and 12*d* of the base 12. The wall member 28 is also preferably made of sheet metal that is stamped and bent to provide the configuration shown. Each leg 28*a* and 28*b* of the wall member 28 has a vertical section and a horizontal section. The first leg 28*a* of the wall member 28 is spaced from the rear wall 12*b* of the base 12 to define a first wire raceway 30. Several electrical wires are housed and routed within the first wire raceway 30. These wires include electrical wires 34 and 35 that are electrically connected to the lamp assembly 18, electrical wires 36 and 37 that are electrically connected to the lamp assembly 20, electrical wire 33 that is electrically connected to electrical wires 35 and 37 and to a wire (not illustrated) connected to a power source (not illustrated), and electrical wire 32 that is electrically connected to electrical wires 34 and 36 and to the rocker switch 26.

Figure 9:
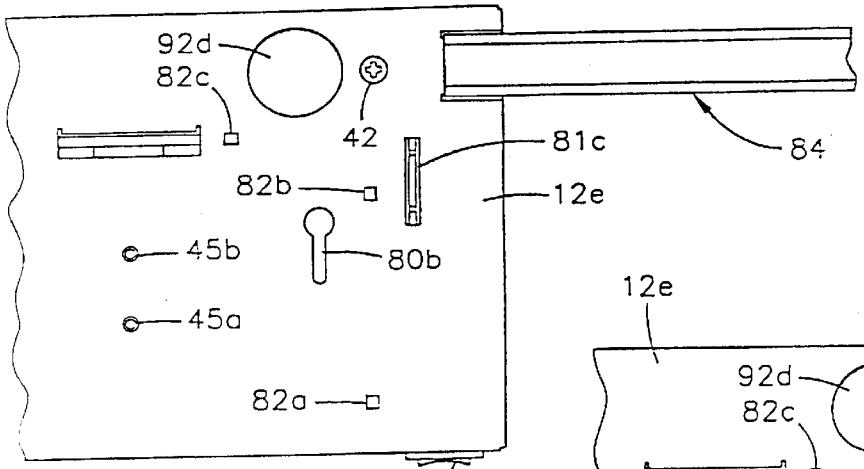
FIG. 9 is a fragmentary view of the top of the base of the light fixture of FIG. 1 and the external wire raceway of FIG. 4, showing the external wire raceway connected to the light fixture.
Figure 8:
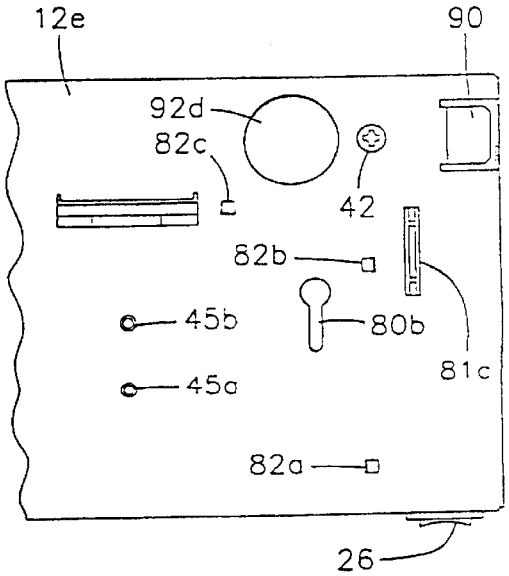
FIG. 8 is a fragmentary view of a top of the base of the light fixture of FIG. 1 showing a tongue formed therein for connection with the external wire raceway of FIGS. 4, 5 and 6.

The second leg 28*b* of the wall member 28 is spaced from the sidewall 12*c* of the base 12 to define a second wire raceway 38. The first wire raceway 30 and the second wire raceway 38 may be considered to be two interconnected wire raceways, or as two segments of a single wire raceway. Wires are housed and routed within the second wire raceway 38, as well as in the first wire raceway 30 as discussed above. The wires in the second wire raceway 38 include electrical wire 32 that is electrically connected to electrical wires 34 and 36 and to the rocker switch 26, and electrical wire 40 that is electrically connected to the rocker switch 26 and to a wire (not illustrated) connected to a power source (not illustrated). The rocker switch 26 preferably has OFF, LOW and HIGH positions. The switch 26 may incorporate a diode (not illustrated) that is switched in and out of the power circuit to halve the AC power delivered to the lamp assemblies 18 and 20, thereby achieving an inexpensive and reliable dimmer control for the lamp assemblies 18 and 20. Additionally, a ground wire (not illustrated) of the light fixture 10 is connected to the inside of the housing with a nut (not illustrated) and a screw 42 (FIGS. 8 and 9) that projects through the top 12*e* of the base 12. In order to ground the housing, the ground wire is connected to another wire (not illustrated) that is connected to electrical ground. All of the electrical wires in the light fixture 10 are insulated, with the exception that the ground wire preferably is not insulated.

The lamp assemblies 18 and 20 are identical. Therefore, only the construction of the lamp assembly 18 will be described. It includes a reflector 44 having a generally curved reflecting surface. The reflector 44 is connected with two rivets 45*a* and 45*b* (FIGS. 3, 8, 9) to a top 12*e* of the base 12, and preferably partially surrounds a socket 46. The contact pins (not illustrated) of a light bulb 48, which is preferably a halogen light bulb, are inserted into the receptacles (not illustrated) of the socket 46, which is secured to the vertical section of the first leg 28*a* of the wall member 28. The receptacles of the socket 46 are electrically connected to electrical wires 34 and 35, which provide electrical power to the light bulb 48.

The bezel assemblies 14 and 16 are identical so only one need be described in detail. The bezel assembly 14 includes a transparent or translucent planar lens element 52 supported in a surrounding rectangular plastic frame 54. The frame 54 includes deflectable resilient tab members 56 and 58 on a leading edge thereof, which hold the bezel assembly 14 in place on the cover 13, and that can be deflected for removal of the bezel assembly 14 to allow access to the lamp assembly 18. The cover 13 of the housing 11 has generally rectangular apertures such as 60 formed therein which are each dimensioned and configured to receive and hold a respective bezel assembly such as 16. Each bezel assembly includes, along its rearward or trailing edge, flanges (not illustrated) which engage the rear edge of the corresponding aperture 60. This allows the bezel assembly 16 to be swung into position and its tabs 56 and 58 registered and locked into corresponding notch portions 62 and 64 of the aperture 60.

As shown in FIG. 3, the sidewalls 12*c* and 12*d* of the base 12 have raised portions adjacent the ends of the first wire raceway 30. A stepped rearward portion 69 of the cover 13 is dimensioned and configured to overlie the raised rearward portions of the sidewalls 12*c* and 12*d* and to enclose the first wire raceway 30. The forward ends of the sidewalls 12*c* and 12*d* have beveled segments 66 and 68. A sloping section 70 of the cover 13 mates with these beveled segments 66 and 68. A front vertical surface 72 of the cover 13 underlies the front wall 12*a* of the base 12. The front vertical surface 72 of the cover 13 is formed with a cutout 74 to allow space for the rocker switch 26. The cover 13 is secured to the base 12 with screws, such as screw 76, which thread through corresponding holes 78 and 79 in the front vertical surface 72 of the cover 13 and the front wall 12*a* of the base 12.

Keyholes 80*a* and 80*b* (FIGS. 3, 8, 9) are formed in the top 12*e* of the base 12 to facilitate using a fastener, for example screws or nuts and bolts (not illustrated), to attach the light fixture 10 to a surface. The light fixture 10 is preferably attached to the underside 22 of a kitchen cabinet, or alternately, to a wall or counter top. Plastic spacers 81*a*, 81*b*, and 81*c* (FIGS. 3, 8 and 9) are mounted in rectangular holes in the top 12*e* of the base 12, to space the light fixture 10 from the underside 22 of the kitchen cabinet to reduce the amount of heat transferred to the cabinet. Bent over tabs 82*a*, 82*b*, and 82*c* (FIGS. 8 and 9) of the wall member 28 secure the wall member 28 to the top 12*e* of the base 12. Additional bent over tabs which also secure the wall member 28 to the top 12*e* of the base 12 are not illustrated.

Figure 4:
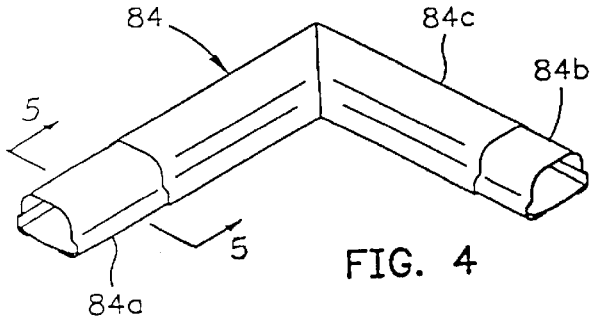
FIG. 4 is a perspective view of an external wire raceway that may be utilized in connection with the light fixture of FIG. 1.

To provide electric power to the light bulbs, the light fixture 10 accommodates various methods of connection with electrical wires from a power source. In most cases the electrical wires supplying electric power will extend from the underside 22 of the cabinet. Breakaway portions 83*a* and 83*b* (FIG. 3) are formed in the ends of the base 12 at each end of the first wire raceway 30, to facilitate connecting the light fixture 10 with the electrical wires supplying electric power. Alternately, the breakaway portions 83*a* and 83*b* could be formed at other locations in the base 12 adjacent the first wire raceway 30 or the second wire raceway 38. Rather than having two breakaway portions, only one, or more than two, breakaway portions could be provided. Each breakaway portion 83*a* and 83*b* is removable from the base 12 to create a respective passageway (not illustrated), also referred to as a hole, shaped and configured to receive a portion of an external wire raceway 84 (FIG. 4). The external wire raceway 84 contains the electrical conductors that supply electric power to the light fixture 10, such as ROMEX™ wire (not illustrated). When the external wire raceway 84 is connected with the light fixture 10, the electrical wires that supply the electric power extend from the end of the external wire raceway 84 into the first wire raceway 30, and possibly also into the second wire raceway 38, inside the light fixture 10. To provide power to the light bulbs such as light bulb 48, the electrical wires from the external wire raceway 84 are connected to electrical wires 33 and 40 of the light fixture 10. The electrical wires in the external wire raceway 84 preferably also include an electrical wire that is connected to electrical ground, for connection with the ground wire in the light fixture 10.

Figure 5:
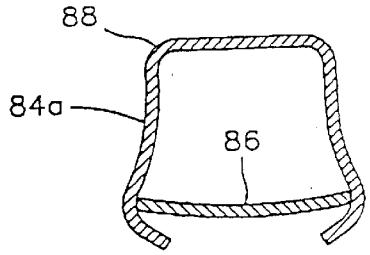
FIG. 5 is an enlarged cross-sectional view of the first straight segment of the external wire raceway viewed along line 5—5 in FIG. 4.

The external wire raceway 84 is preferably assembled from metal components that are commercially available under the trademark WIREMOLD from The Wiremold Company Electrical Division, 60 Woodlawn Street, West Hartford, Conn. This product is designed to enclose electrical conductors such as ROMEX wire. The external wire raceway 84 may include a first straight segment 84*a* and a second straight segment 84*b* connected by a right angle portion 84*c*. It will be understood that the use of straight segments, right angle segments, and so forth will be dependent upon the path that the wiring takes beneath the underside 22 of the kitchen cabinet. As illustrated in FIG. 5, the first straight segment 84*a* of the external wire raceway 84 includes a curved bottom section 86 and a cover section 88. The cover section 88 has springy or resilient curved lower edges that squeeze therebetween the bottom section 86.

Figure 6:
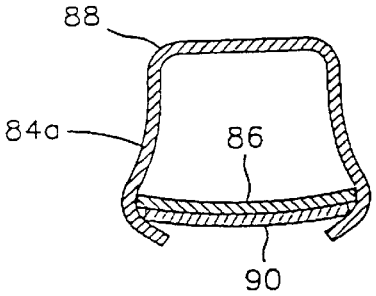
FIG. 6 is a cross-sectional view illustrating a tongue inserted into the first straight segment of the external wire raceway of FIG. 5.

To secure the external wire raceway 84 to the base 12, a tongue 90 (FIGS. 3 and 8) is formed in the top 12*e* of the base 12 adjacent breakaway portion 83*b*. Similarly, an identical tongue (not illustrated) is formed adjacent breakaway portion 83*a*. Preferably, each tongue is formed in the top 12*e* of the base 12 by stamping and bending. The tongue 90 is curved and dimensioned to fit snugly between the sidewalls of the cover section 88 of the first straight segment 84*a* of the external wire raceway 84, as best seen in FIG. 6. The tongue 90 is slid snugly beneath the bottom section 86 of the first straight segment 84*a* of the external wire raceway 84 to firmly connect the external wire raceway 84 to the metal housing 11 of the light fixture 10. If desired, the tongue 90 could instead be connected to the second straight segment 84*b* of the external wire raceway 84.

In configurations using more than one light fixture 10, the electrical power could be routed between light fixtures with interconnecting external wire raceways 84. For example, electrical wires in a first external wire raceway would enter the light fixture 10 at the passageway created by removal of breakaway portion 83*a*. These wires from the first external wire raceway would be connected to wires in the light fixture 10 to supply electrical power to the light fixture 10, and would also be connected to wires from a second external wire raceway entering the opposite end of the light fixture 10 at the passageway created by removal of breakaway portion 83*b*. The second external wire raceway would also be connected to a second light fixture 10, and the wires in the second external wire raceway would supply electrical power to the second light fixture 10.

Figure 7:
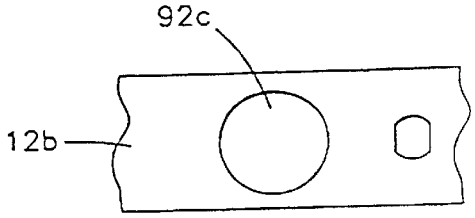
FIG. 7 is a fragmentary view of a back of a base of the light fixture of FIG. 1 showing a punch out portion.

To provide another method for connecting the light fixture 10 with a power source, three removable punch out portions 92*a*, 92*b*, and 92*c* (FIGS. 3 and 7) are formed in the rear wall 12*b* of the base 12 adjacent the first wire raceway 30, and a fourth punch out portion 92*d* (FIGS. 8 and 9) is formed in the top 12*e* of the base 12 adjacent the first wire raceway 30. Alternately, the punch out portions could be formed at other locations in the base 12 adjacent the first wire raceway 30 or the second wire raceway 38. Also, rather than having four punch out portions, less than four, or more than four punch out portions could be provided. The punch out portions 92*a*, 92*b*, 92*c*, and 92*d* facilitate connecting the light fixture 10 with electrical wires that supply electrical power to the light fixture 10, such as ROMEX wires, that are not housed in an external wire raceway. Electrical wires supplying electrical power that are not housed in an external wire raceway will generally be brought from the woodwork of the cabinet to behind, or above, the light fixture 10. To connect the light fixture 10 with the electrical wires supplying the electrical power, one of the punch out portions 92*a*, 92*b*, 92*c*, or 92*d* is removed from the base 12 to create a corresponding hole through which the electrical wires are passed into the first wire raceway 30 inside the housing 11. To provide electrical power to the light bulbs, the electrical wires supplying the electrical power are connected to electrical wires 33 and 40 of the light fixture 10. The electrical wires that are passed through the hole into the first wire raceway 30 preferably also include an electrical wire that is connected to electrical ground, for connection with the ground wire in the light fixture 10.

While I have described a preferred embodiment of my under cabinet halogen light fixture with an internal wire raceway, it will be understood by those skilled in the art that my invention may be modified in both arrangement and detail. For example, the shape of the breakaway portions could be changed to create passageways shaped to receive other types of external wire raceways. The rocker switch could be replaced with a toggle switch, slide switch, push button switch, touch sensitive capacitive switch or any other form of UL approved switch commonly used in light fixtures. The lamp assemblies could be replaced with hockey puck style halogen lamp assemblies mounted in round openings formed in the cover. These and other changes and modifications to my invention will be readily apparent to designers of light fixtures. Therefore, the protection afforded my invention should only be limited in accordance with the scope of the following claims.

What is claimed is:

1. A light fixture having an internal configuration for routing electrical wires, the light fixture comprising:

a housing having a base and a removable cover, the base and the cover when mated defining a hollow interior, and the cover being formed with an aperture opening into the interior;

a bezel assembly mounted in and covering the aperture in the cover;

a wall member located in the housing, the wall member being shaped and configured to cooperate with at least one side of the base to define at least one internal raceway in the interior of the housing for routing the electrical wires to a lamp assembly;

a lamp assembly aligned with the aperture and bezel assembly and comprising a socket mounted to the wall member and receiving the electrical wires, a reflector mounted to the base and partially surrounding the socket, and a light bulb removably connected in the socket between the reflector and the aperture in the cover; and at least a portion of the bezel assembly allowing light from the lamp assembly to pass therethrough.

2. The light fixture of claim 1 wherein an end of the base of the housing is formed with a breakaway portion, the breakaway portion being formed adjacent the internal wire raceway, the breakaway portion being removable from the base to create a passageway shaped and configured for receiving an external wire raceway into the internal wire raceway.

3. The light fixture of claim 2 wherein the base of the housing is formed with a tongue adjacent the breakaway portion, the tongue being shaped and configured for insertion into the external wire raceway for connection therewith.

4. The light fixture of claim 1 wherein the base of the housing is formed with a punch out portion, the punch out portion being formed adjacent the internal wire raceway, and the punch out portion being removable from the base to create a hole in the base for passing the electrical wires therethrough into the internal wire raceway.

5. The light fixture of claim 1 wherein the wall member is shaped and configured to define a plurality of interconnected internal wire raceways.

6. The light fixture of claim 5 wherein the wall member is generally L-shaped.

7. The light fixture of claim 1 wherein the light bulb is a halogen light bulb.

8. The light fixture of claim 1 further comprising a switch mounted to the housing and electrically connected to the light bulb.

9. The light fixture of claim 1 wherein the bezel assembly is movable to allow access to the light bulb.

10. The light fixture of claim 1 further comprising a second aperture in the cover, a second lamp assembly mounted inside the housing adjacent the second aperture in the cover, and a second bezel assembly mounted in the second aperture in the cover, at least a portion of the second bezel assembly allowing light from the second lamp assembly to pass therethrough.

* * * * *